US007780581B1

(12) United States Patent
Emmert

(10) Patent No.: US 7,780,581 B1
(45) Date of Patent: Aug. 24, 2010

(54) FOOT PLATE ASSEMBLY WITH ADJUSTABLE SYMMETRIC RETENTION STRAP ARRANGEMENT

(75) Inventor: Raymond L. Emmert, Oklahoma City, OK (US)

(73) Assignee: Emmert Second Limited Partnership, Humacao, PR (US)

( * ) Notice: Subject to any disclaimer, the term of this patent is extended or adjusted under 35 U.S.C. 154(b) by 1497 days.

(21) Appl. No.: 11/019,795

(22) Filed: Dec. 20, 2004

(51) Int. Cl.
*A63B 25/02* (2006.01)

(52) U.S. Cl. ..... 482/75; 482/76; 135/65

(58) Field of Classification Search ..... 482/75, 482/76; 36/7.7, 7.6, 122, 50.1; 623/28
See application file for complete search history.

(56) References Cited

U.S. PATENT DOCUMENTS

| | | | | | |
|---|---|---|---|---|---|
| 442,003 | A | * | 12/1890 | Armstrong | 36/7.6 |
| 780,020 | A | * | 1/1905 | Brent | 36/50.1 |
| 1,103,108 | A | * | 7/1914 | Van Wie | 36/7.7 |
| 1,654,348 | A | * | 12/1927 | Rzucidlo | 36/7.6 |
| 1,837,730 | A | * | 12/1931 | Smith | 36/7.6 |
| 2,484,389 | A | * | 10/1949 | Schatz | 36/7.6 |
| 2,807,098 | A | * | 9/1957 | Wunker | 36/7.6 |
| 2,813,356 | A | * | 11/1957 | Webb | 36/7.6 |
| 3,046,678 | A | * | 7/1962 | Ramon | 36/7.6 |
| 3,102,272 | A | | 9/1963 | Emmert | |
| 3,626,519 | A | * | 12/1971 | Baker | 623/28 |
| 3,902,199 | A | | 9/1975 | Emmert | |
| 5,074,548 | A | | 12/1991 | Sawyer | |
| 5,593,373 | A | | 1/1997 | Hale | |
| 5,645,515 | A | | 7/1997 | Armstrong et al. | |
| 6,159,173 | A | | 12/2000 | Morales | |
| 6,517,586 | B2 | | 2/2003 | Lin | |
| 2001/0010131 | A1 | * | 8/2001 | Lancon | 36/122 |
| 2003/0230007 | A1 | * | 12/2003 | Walton | 36/15 |

* cited by examiner

*Primary Examiner*—Jerome Donnelly
(74) *Attorney, Agent, or Firm*—Fellers, Snider, et al.

(57) ABSTRACT

An apparatus attachable to a foot of a user, such as in a leg extension mechanism (stilt device). First and second support members extend from opposing sides of a foot support surface adapted to support the foot. A retention strap has opposing first and second ends each removeably attachable to the support members by the user, preferably by an opposing pair of buckle assemblies. The strap, the support members and the foot support surface maintain the strap in a semi-circular arc nominally symmetric about a centerline of the surface, with the arc having a width greater than a width of the foot support surface to facilitate insertion of the foot between the surface and the strap along the centerline. The support members are preferably slideably adjustable to accommodate different foot widths. A toe guide is also preferably slideably adjustable to align the toes of the foot along the centerline.

21 Claims, 4 Drawing Sheets

FOOT PLATE ASSEMBLY WITH ADJUSTABLE SYMMETRIC RETENTION STRAP ARRANGEMENT

FIELD OF THE INVENTION

This invention relates generally to the field of foot attachment mechanisms and more particularly, but without limitation, to a foot plate assembly with a symmetric retention strap and foot positioning arrangement to attach a foot of a user to the assembly, such as in a leg extension mechanism (stilt device).

BACKGROUND

Leg extension mechanisms (stilt devices) advantageously allow a user to maneuver at an increased height above a base surface. Stilt devices are often used in the construction industry to allow users to perform building or repair operations several feet above the ground and which could not otherwise be reachable without use of a scaffold or support structure. A particularly useful stilt device is disclosed in U.S. Pat. No. 3,902,199 issued to Emmert.

While operable, there remains a continual need for advancements in the art to improve flexibility, adjustability, and user comfort in foot attachments in stilt devices as well as in other applications. There remains a related need to rapidly and repeatedly affix a user's foot in a comfortable and secure predetermined position on the foot plate in order to have a correct individual center of gravity and to promote balanced functioning of the stilt device or other application. It is to these and other improvements that the present invention is generally directed.

SUMMARY OF THE INVENTION

An apparatus is provided for attachment to a foot of a user, such as but not limited to a stilt device.

In accordance with preferred embodiments, first and second support members extend from opposing sides of a foot support surface adapted to support a foot of the user. A retention strap has opposing first and second ends each removably attachable to the respective first and second support members by the user, preferably by an opposing pair of buckle assemblies.

The strap, the support members and the foot support surface are configured to maintain the strap in a semi-circular arc nominally symmetric about a centerline of the foot support surface. The arc has a width greater than a width of the surface to facilitate insertion of the foot between the strap and the surface along the centerline. The strap preferably extends adjacent the arch of the foot, while additional straps are provided to secure the heel and the toes of the foot after insertion.

In accordance with further embodiments, the first and second support members are slideably adjustable with respect to the foot support surface to accommodate different foot widths. In still further embodiments, the toe strap includes a toe guide assembly with an inner alignment surface that is slideably adjustable with respect to the foot support surface to align the direction of the toes with the centerline of the foot support surface.

These and various other features and advantages which characterize the claimed invention will be apparent from a reading of the following detailed description and a review of the associated drawings.

DETAILED DESCRIPTION

Numerous possible variations and modifications will readily occur to the skilled artisan upon a review of the following discussion. Thus, it will be understood that the various exemplary embodiments disclosed herein are illustrative of, and are not limiting to, the scope of the claimed invention.

Figure 1:
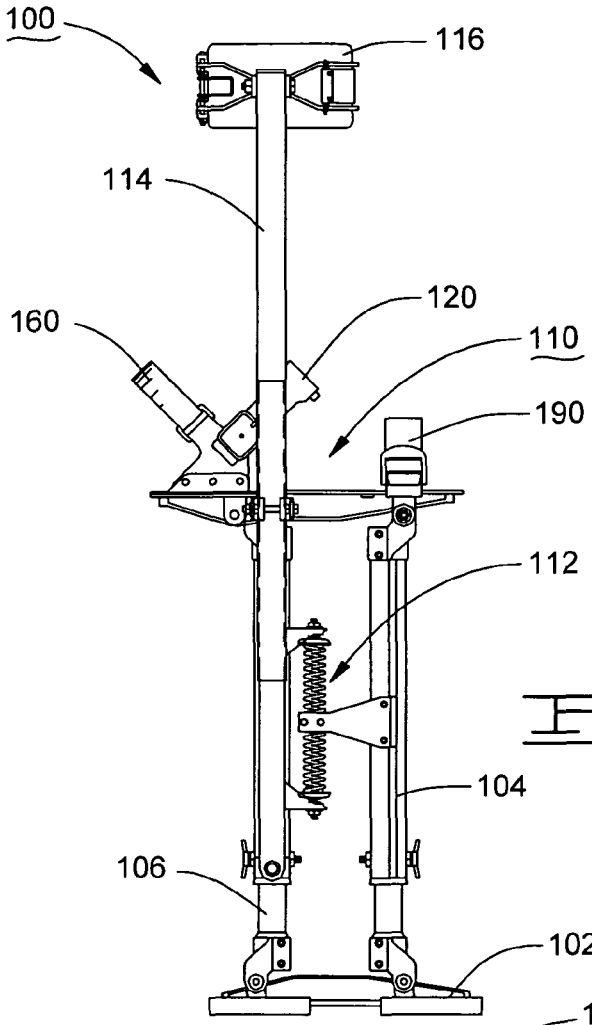
FIG. 1 provides an elevational side view representation of a stilt device incorporating a foot plate assembly constructed in accordance with preferred embodiments of the present invention.

FIG. 1 generally illustrates a stilt device 100 configured to support a user at a desired elevation above a floor. Two such devices 100 are preferably supplied to permit attachment to the respective left and right feet of the user.

A support member 102 rests upon the floor. Telescopic front and rear struts 104, 106 project upwardly from the support member to support a foot plate assembly 110, which will be discussed in greater detail below.

A damping assembly 112 nominally biases the stilt device 100 to the parallelogram shape shown in FIG. 1. The damping assembly 112 further provides flexibility to the user by permitting limited forward and rearward pivoting of the struts 104, 106 with respect to the shoe plate 102 during maneuvering by the user.

A telescopic leg attachment mechanism 114 extends adjacent the foot plate assembly 110. The mechanism 114 preferably terminates with a clam-shell assembly 116 which surrounds and supports the user's leg at a position adjacent the knee.

Figure 2:
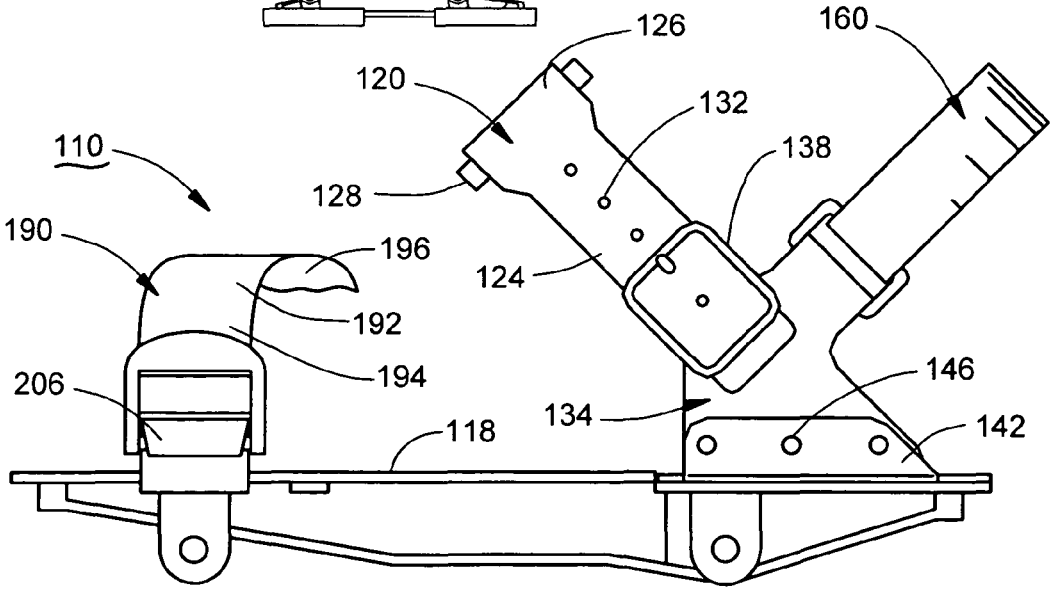
FIG. 2 provides an elevational side view representation of the foot plate assembly of FIG. 1.

The foot plate assembly 110 is shown in greater detail in FIG. 2. A foot plate 118 provides a foot support surface adapted to support the foot of the user preferably while the user wears a shoe (protective work boot, etc.) on the foot, although such is not necessarily required. The plate 118 is preferably formed of rigid material such as injection molded plastic.

A retention strap 120 (also referred to herein as a first strap) extends across the plate to secure the arch (top) of the foot to the plate 118. As further shown in FIGS. 3 and 4, the strap 120 preferably has an elongated, substantially rectangular shape and includes a medial portion 122 and opposing first and second ends 124, 126. The strap 120 is preferably formed of leather or other flexible, substantially non-elastic material.

Figure 3:
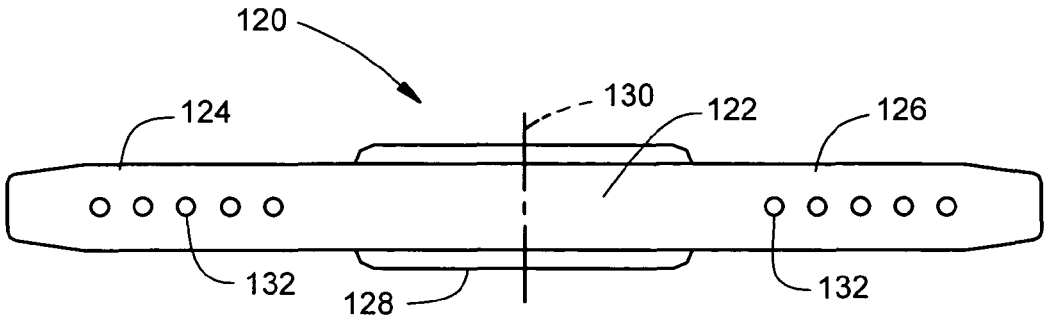
FIG. 3 is a top plan view of a foot retention strap of the assembly of FIG. 2 in accordance with a preferred embodiment.
Figure 4:
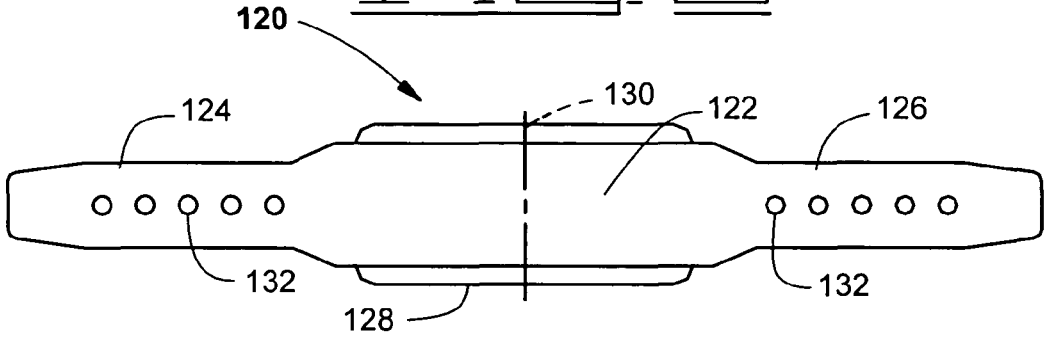
FIG. 4 is a top plan view of the foot retention strap in accordance with an alternative preferred embodiment.

The strap 120 is preferably provided with a substantially consistent width as shown in FIG. 3, but can alternatively have a wider medial portion 122 as shown in FIG. 4. A cushioning pad 128 is preferably affixed to the inner surface of the medial portion 122 in facing relationship to the plate 118. From FIGS. 3 and 4 it will be noted that the strap 120 is preferably nominally symmetric about a centerline of the plate 118 along which the foot of the user is inserted (denoted by broken line 130).

A plurality of spaced apart fastening apertures 132 are preferably provided in each of the ends 124, 126. This permits the strap 120 to be removeably attachable by the user to first and second support members 134, 136 via opposing buckle assemblies 138, 140, as best viewed in FIGS. 5 and 6.

The support members 134, 136 are preferably formed of leather or other flexible, non-elastic material. The support members 134, 136 are affixed to opposing sides of the plate 118 by way of brackets 142, 144. Each bracket 142, 144 is preferably L-shaped with a vertical portion (not numerically designated) to which the associated member 134, 136 is affixed via rivets 146, and a horizontal portion with elongated slots 148 (FIG. 5) through which threaded fasteners 150 extend.

The brackets 142, 144 can be adjustably slid in and out to set the desired distance between the opposing support members 134, 136. Preferably, the brackets will be adjusted by the user so as to abut opposing sides of the foot while the foot is centered along the centerline 130. This facilitates the use of the assembly 118 with a wide range of different foot widths.

A distal tab 152 on each member 134, 136 is looped over a cross-bar (not shown) of the respective buckle assemblies 138, 140 and secured via rivets 154. A pivotable tooth 156 preferably projects from the cross-bar and through a selected one of the apertures 132 to secure the strap 120 in an otherwise conventional fashion.

Returning again to FIG. 2, the foot plate assembly 110 further includes a second retention strap 160. The strap 160 retains a portion of the foot adjacent the heel and preferably includes a medial portion 162 and first and second ends 164, 166. The strap 160 is preferably formed of a weave material but can also be formed of leather, etc. As with the strap 120, the strap 160 is further preferably configured to be substantially non-elastic.

Figure 5:
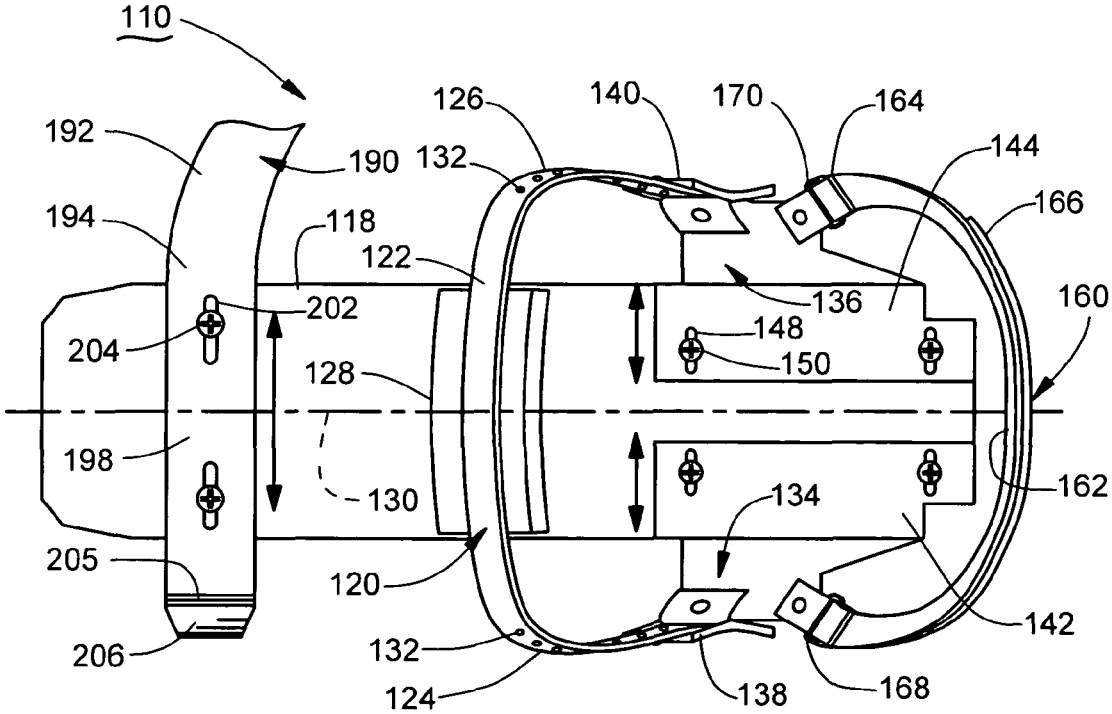
FIG. 5 provides a top plan view of the foot plate assembly.

As additionally shown in FIG. 5, loops are formed by the first and second ends 164, 166 so as to pass through respective rings 168, 170 of the support members 134, 136. Hook and loop fasteners are preferably utilized to permit one or both of the ends 164, 166 to be adjusted by the user. Preferably, the length of the strap 160 is elongated as shown in FIG. 5 so that the foot can be inserted along the centerline 130 while the end 166 is loosely pre-threaded through ring 168, after which the strap 160 is cinched to the requisite tension and the end 166 is affixed against the medial portion 162 as shown in the final configuration of FIG. 5.

Preferably, the first strap 120 is arrayed to align adjacent the arch of the foot and the second strap 160 is arrayed to align adjacent the heel of the foot, as shown in FIGS. 2 and 5. However, such is not necessarily required; that is, the relative locations of these respective straps can be reversed as that shown in FIGS. 2 and 5 so that the strap 120 is maintained in the semi-circular arrangement of FIG. 6 for insertion of the heel against the strap 120, after which the strap 160 is used to secure the arch of the foot.

Figure 6:
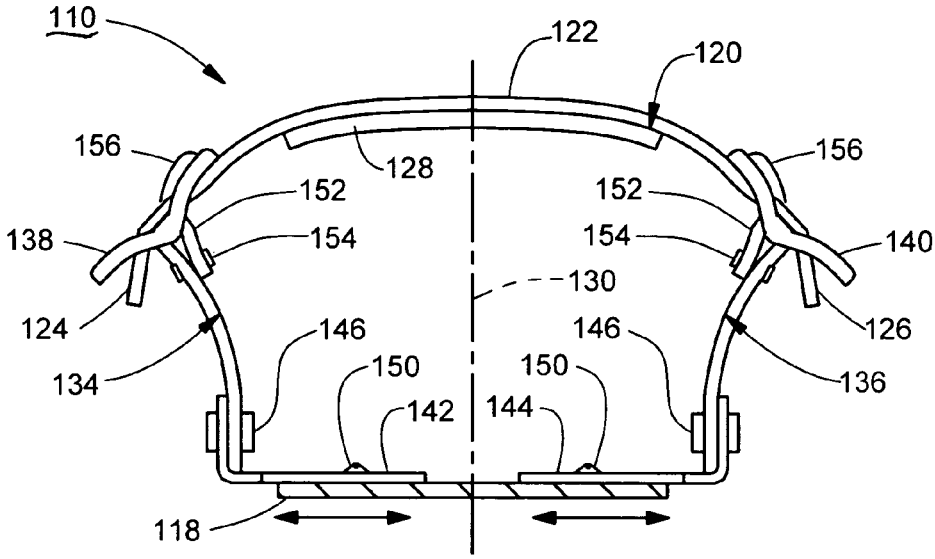
FIG. 6 is an end, partial cross-sectional view of the foot plate assembly.
Figure 7:
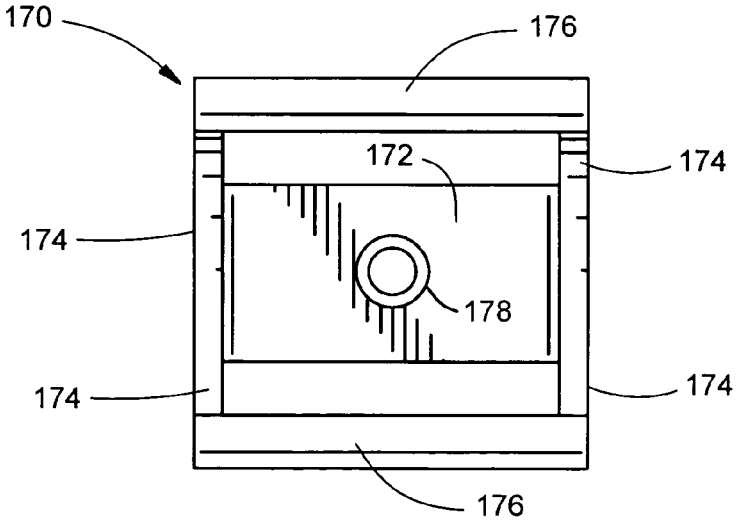
FIGS. 7-9 provide respective views of an alternative buckle assembly preferably used to maintain the strap in the semi-circular arrangement shown in FIG. 6.
Figure 8:
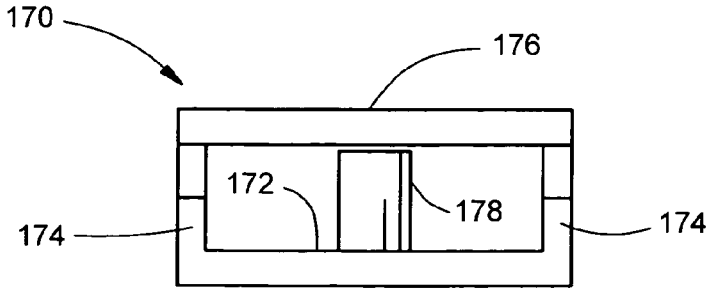
Figure 9:
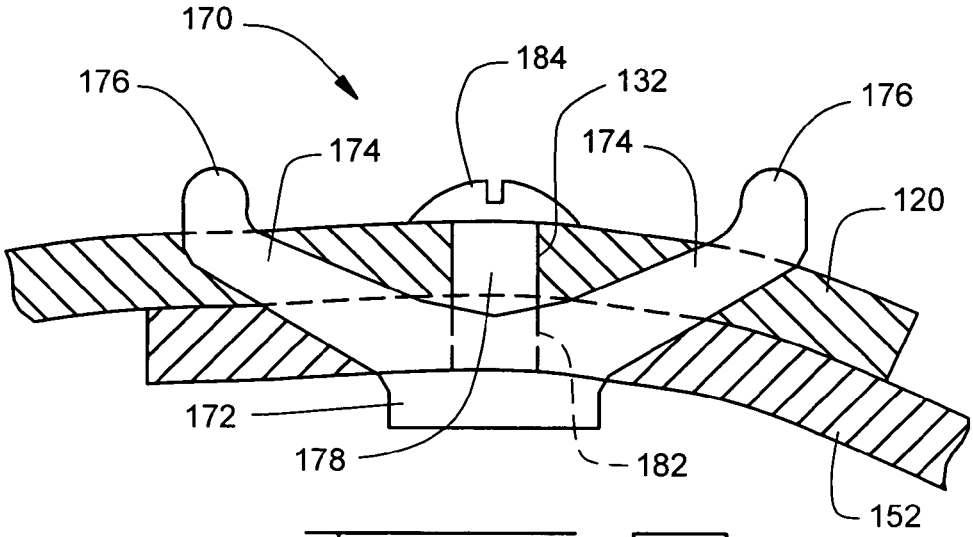

While substantially conventional buckle assemblies have been incorporated into the arrangements of FIGS. 2, 5 and 6 to affix the strap 120 to the plate 118, such is not necessarily required. For example, an alternative buckle assembly 170 is depicted in FIGS. 7-9. The assembly 170 comprises a base (cross-bar) 172 from which extend a set of substantially divergent, y-shaped support arms 174. A pair of retention bars 176 are supported at each end by the respective arms 174. A retention post 178 extends upwardly from the base 172.

Mating engagement of the strap 120 with the tab 152 of the associated support member (e.g., 134, 136) can be effected as shown in FIG. 9. More particularly, the post 178 is inserted through an aperture 182 in the tab 152 so that the tab 152 abuts the base 172 and extends through the respective gaps between the base 172 and bars 176 in a first direction. The associated end (e.g., 124, 126) of the strap 120 is next inserted in the opposite direction through the aforementioned gaps and aligned so that the post 178 projects through a selected one of the fastener apertures 132.

Tension forces upon the strap 120 will generally be applied along a direction normal to the post 178. It is thus contemplated that the post will be sufficient to retain the respective strap 120 and tab 152 to the assembly 170. However, a threaded fastener 184 can be inserted into the distal end of the post 178 to further secure the strap 120 and the tab 152 to the assembly 170, as depicted in FIG. 9.

Referring again to FIG. 5, a toe retention strap 190 (also referred to as a third strap) is preferably utilized to secure the foot at a position adjacent the toes. As before, the strap 190 is preferably non-elastic and formed of a weave, although leather or other suitable materials can be employed as desired.

Figure 10:
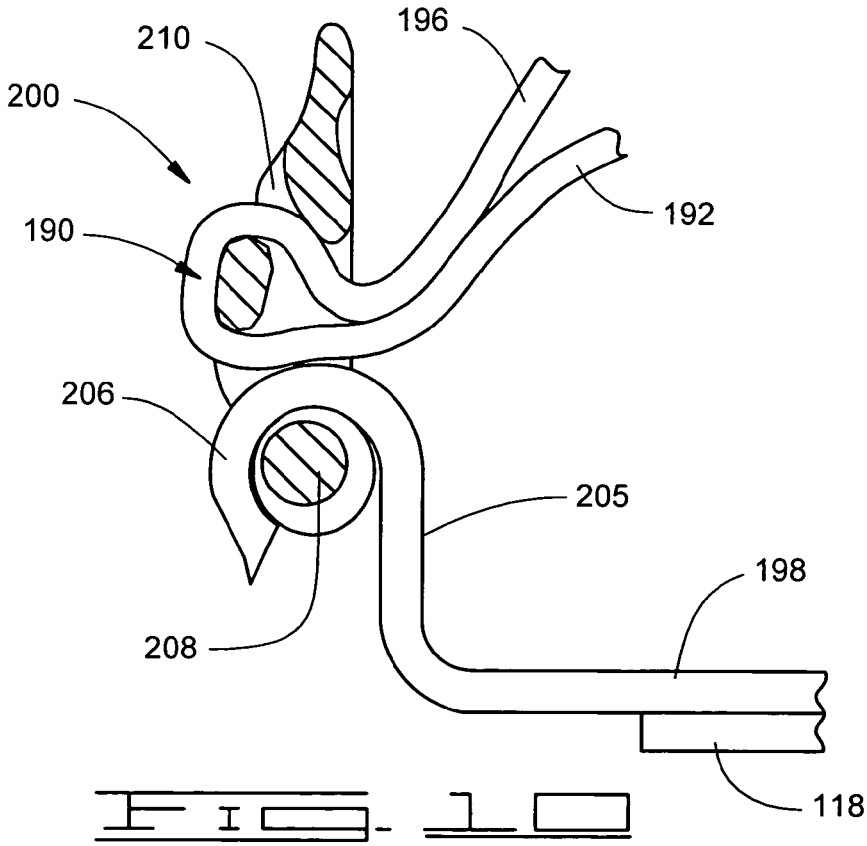
FIG. 10 provides an elevational, partial cross-sectional representation of another buckle assembly used to retain the toes of the foot to the plate.

The strap 190 includes a medial portion 192, a first end 194 which is preferably permanently affixed to the plate 118, and a second end 196 which engages a combination guide plate and buckle clip member ("guide plate") 198 via buckle assembly 200 (FIG. 10). Elongated apertures 202 permit the guide plate 198 to be slideably adjusted relative to the foot plate 118 and secured via fasteners 204. This provides an inner stop surface 205 against which the toes of the foot (e.g., inner surface of the shoe, etc.) can be abuttingly aligned so that the toes extend in the direction of the centerline 130.

The buckle assembly 200 includes a u-shaped clip (channel) 206 which projects from the guide plate 198 to receive an engagement bar 208 of a buckle housing 210. The strap 190 is threaded through the housing 210 as shown to provide a frictional stop when the housing 210 is engaged with the clip 206. In this way, the user can removably adjust the effective length of the strap 190 before or after insertion of the foot into the foot plate assembly 110.

Configuring the retention strap 120, support members 134, 136 and plate 118 in accordance with the foregoing discussion advantageously allows the strap 120 to be substantially maintained in a semi-circular arc nominally symmetric about the centerline 130 prior to insertion of the foot, as shown in FIG. 6. The base of this arc (i.e., the lateral distance between the opposing buckle assemblies 138, 140) is wider than the width of the foot support surface provided by the plate 118, and the support members 134, 136 preferably "lay-over" or extend away from the centerline 130. This provides an elongated access opening for the foot to be inserted into the assembly 110.

Using the configuration of FIG. 5, the user inserts the toe of the foot between the strap 120 and the plate 118, and advances the foot forward until the arch (top) contactingly engages the strap 120. This pulls the support members 134, 136 into a more upright orientation and in abutting alignment with the sides of the foot, and causes the strap 120 to contactingly wrap around the arch of the foot. It will be noted that at this point the arc defined by the strap 120 will have increased in height and the base distance between the respective ends 124, 126 will have been reduced so that the ends 124, 126 are substantially aligned with the edges of the plate 118.

In this way, the strap 120 both facilitates easy insertion of the foot into the assembly 110, as well as provides a fixed reference so that the foot can be repeatedly secured in the same position upon each insertion operation. Indeed, the preferred adjustability of the strap 120, the support members 134, 136 and the toe guide 198 allow any number of different sizes and shapes of feet (and shoes) to be properly oriented on the plate 118 in a highly repeatable manner. Moreover, removeably attaching both ends of the strap 120 to the respective support members 124, 126 maintains the pad 128 nominally centered against the foot irrespective of the effective length of the strap 120.

While the configurations of FIGS. 2 and 5 have used the conventionally configured buckle assemblies 138, 140 to secure the respective ends 124, 126 of the strap 120, it will be noted that such is not limiting; rather, the respective ends 124, 126 of the strap 120 can alternatively be affixed to the respective members 132, 134 using the buckle assemblies 170 of FIGS. 7-9, the buckle assembly 200 of FIG. 10, the hook and loop fasteners of strap 160 in FIG. 5, or any number of other removeably attachable fasteners activatable by the user such as snaps, tabs, braids, etc. It is also not necessarily required that the respective fastening mechanisms be identical, so long as both ends of the strap can be removeably adjusted (i.e., set and then reset) by the user.

Finally, it will be noted that while the foot plate assembly 110 has been described as being preferably incorporated into the stilt device 100, such is merely illustrative in nature and is not limiting. Rather, the assembly 110 can be adapted for any number of different environments including footwear, snow boards, water skis, stirrups, or any other type of application where it is desirable to provide foot support for a human, whether or not a shoe is worn on the foot. It is not necessary to provide a separate plate (such as the plate 118); rather, the foot support surface can form a portion of a larger surface of a device (e.g., a snow board) in which case the foot support surface comprises that portion of the surface configured to support the foot.

It is to be understood that even though numerous characteristics and advantages of various embodiments of the present invention have been set forth in the foregoing description, together with details of the structure and function of various embodiments of the invention, this detailed description is illustrative only, and changes may be made in detail, especially in matters of structure and arrangements of parts within the principles of the present invention to the full extent indicated by the broad general meaning of the terms in which the appended claims are expressed.

What is claimed is:

1. An apparatus, comprising:

a rigid foot plate comprising a foot support surface adapted to support a shoe worn on a foot of a user at a plurality of different fixed reference positions along a centerline of the surface;

first and second support members which extend from opposing sides of the foot support surface;

a first retention strap comprising a medial portion configured to extend across and retain said foot to the surface and opposing first and second ends each removeably attachable to the respective first and second support members by the user, wherein the first retention strap, the support members and the surface are configured to maintain the first retention strap in a semi-circular arc nominally symmetric about a longitudinal centerline of the surface, the arc having a width greater than a width of the surface to facilitate insertion of the foot between the first retention strap and the surface along said centerline, wherein during said insertion the first retention strap limits further movement of the foot along said centerline upon contacting engagement of the shoe with the first retention strap to establish a selected fixed reference position for the shoe relative to the surface; and a second retention strap coupled to the first and second support members and configured to be subsequently cinched to attach and retain said foot to said surface after said insertion, wherein a selected one of the first or second retention straps extends adjacent an arch portion of the foot, and wherein a remaining one of the first or second retention straps extends adjacent a heel portion of the foot.

2. The apparatus of claim 1, further comprising a first buckle assembly which affixes the first end of the first retention strap to the first support member and a second buckle assembly which affixes the second end of the first retention strap to the second support member.

3. The apparatus of claim 2, wherein at least one of the first and second buckle assemblies comprises a pivotable tooth which extends through a corresponding aperture in the respective first and second ends.

4. The apparatus of claim 2, wherein at least one of the first and second buckle assemblies comprises a stationary post which extends through a corresponding aperture in the respective first and second ends.

5. The apparatus of claim 4, further comprising a threaded fastener which extends into the stationary post to secure the respective end to the associated buckle assembly.

6. The apparatus of claim 1, wherein at least a selected one of the first and second support members is slidingly adjustable relative to the surface in a direction substantially normal to the centerline to accommodate different foot widths.

7. The apparatus of claim 1, further comprising a cushioning pad affixed to the medial portion of the first retention strap so as to be disposed between the first retention strap and the surface, wherein the first retention strap, support members and plate maintain the pad nominally symmetric about the centerline.

8. The apparatus of claim 1, wherein the first retention strap extends adjacent the arch portion of said foot, and the second retention strap is subsequently cinched adjacent the heel portion of said foot.

9. The apparatus of claim 1, wherein the second retention strap extends adjacent the heel portion of said foot, and the first retention strap is subsequently cinched adjacent the arch portion of said foot.

10. The apparatus of claim 1, wherein the foot support surface of the foot plate is characterized as a planar support surface which allows continuous movement of the shoe along the centerline unimpeded by a heel limit feature adjacent the heel of the shoe and unimpeded by a toe limit feature adjacent the toe of the shoe.

11. The apparatus of claim 1, further comprising a third retention strap which extends adjacent a toe of the user, wherein the third retention strap is configured to be cinched after said insertion.

12. The apparatus of claim 1, wherein the foot support surface is formed on a foot plate of a stilt device.

13. An apparatus, comprising:

a rigid foot plate comprising a foot support surface adapted to support a shoe worn on a foot of a user;

first and second support members which extend from opposing sides of the foot support surface, wherein at least one of said first and second support members is slidingly adjustable relative to the surface in a direction substantially normal to a centerline along which the foot and shoe are inserted to mate with the plate;

a first retention strap comprising:

a medial portion configured to extend across and retain said foot and shoe to the surface; and opposing first and second strap end portions, each strap end portion removeably attachable to one of the first and second support members by the user, wherein the first retention strap establishes a fixed reference position for the foot by contactingly engaging and limiting further movement of the shoe along the centerline without concurrent contact between the shoe and a heel limit feature or a toe limit feature of the plate along said centerline; and a second retention strap coupled to the first and second support members and configured to be subsequently cinched to attach the shoe to said surface after said insertion, wherein a selected one of the first or second retention straps contactingly engages an arch portion of the shoe, and wherein a remaining one of the first or second retention straps contactingly engages a heel portion of the shoe.

14. The apparatus of claim 13, wherein the remaining one of the first and second support members is also slidingly adjustable relative to the surface in said direction substantially normal to said centerline.

15. The apparatus of claim 13, wherein the first retention strap, the support members and the surface are configured to maintain the first retention strap in a semi-circular arc nominally symmetric about the centerline of the surface, the arc having a width greater than a width of the surface to facilitate insertion of the foot and shoe between the surface and the first retention strap along said centerline.

16. The apparatus of claim 13, further comprising a pair of opposing brackets, each bracket coupling a respective one of the first and second support members to the surface, each bracket further comprising at least one elongated aperture through which a fastener extends to adjust the bracket relative to the surface.

17. An apparatus, comprising:

first and second support members which extend from opposing sides of a foot support surface adapted to support a shoe worn on a foot of a user;

a retention strap comprising a medial portion configured to extend across and retain said foot to the foot support surface and opposing first and second strap end portions, each strap end portion removeably attachable to the respective first and second support members by the user to establish a single fixed reference for the foot when the shoe contactingly engages the strap during insertion of the shoe under the strap and movement of the shoe in a direction toward the strap; and a toe guide affixed to the surface to provide an inner alignment surface against which a toe portion of said shoe abuts when the foot is inserted to mate with the foot support surface, the toe guide slideably adjustable with respect to the foot support surface in a direction perpendicular to the centerline.

18. The apparatus of claim 17, further comprising a toe strap configured to engage the toe guide to secure the toe of the foot to the foot support surface.

19. The apparatus of claim 17, wherein the retention strap is adapted to extend across an arch of the foot, and wherein the apparatus further comprises a heel strap which extends between the first and second support members to secure a heel of the foot to the foot support surface after the shoe contactingly engages the retention strap.

20. The apparatus of claim 17, wherein the retention strap is adapted to extend across a heel of the foot, and wherein the apparatus further comprises an arch strap which extends between the first and second support members to secure an arch of the foot to the foot support surface after the shoe contactingly engages the retention strap.

21. The apparatus of claim 17, wherein the retention strap, the support members and the foot support surface are configured to maintain the retention strap in a semi-circular arc nominally symmetric about the centerline of the foot support surface, the arc having a width greater than a width of the foot support surface to facilitate insertion of the foot between said surface and the strap along said centerline.

* * * * *